US005971744A

United States Patent [19]

Eaton

[11] Patent Number: 5,971,744

[45] Date of Patent: Oct. 26, 1999

[54] GAS BURNER TOOL FOR PURGING A GAS SUPPLY PIPE

[76] Inventor: Timothy C. Eaton, 27 Haliburton Bay, Winnipeg, Manitoba, Canada, R3K 1E1

[21] Appl. No.: 08/872,923

[22] Filed: Jun. 11, 1997

[51] Int. Cl.[6] ..... F23D 14/00; F23D 5/00; F23D 14/46

[52] U.S. Cl. ..... 431/5; 431/202; 431/350; 431/356; 431/355

[58] Field of Search ..... 431/5, 202, 355, 431/344, 343, 356, 350, 29, 30; 48/179; 248/79, 678, 303, 315, 346.03, 129; 220/581; 126/406, 405, 39 R, 44; 206/378, 350, 443, 733, 303

[56] References Cited

U.S. PATENT DOCUMENTS

| | | | |
|---|---|---|---|
| 2,537,091 | 1/1951 | Rodman et al. | 421/5 |
| 2,564,371 | 8/1951 | Parsberg | 431/355 |
| 3,127,986 | 4/1964 | Hulka | 206/303 |
| 3,210,537 | 10/1965 | Groves | 431/343 |
| 3,260,489 | 7/1966 | Hentzi | 248/79 |
| 3,291,296 | 12/1966 | Lemkelde | 206/303 |
| 3,574,506 | 4/1971 | Locke | 431/344 |
| 3,833,335 | 9/1974 | Lazarre et al. | 431/202 |
| 4,009,985 | 3/1977 | Hirt | 431/5 |
| 4,058,147 | 11/1977 | Stary et al. | 431/5 |
| 4,118,170 | 10/1978 | Hirt | 431/5 |
| 4,253,716 | 3/1981 | Turner, Jr. | 206/443 |
| 4,276,017 | 6/1981 | Julien . | |
| 4,344,751 | 8/1982 | Chesters | 431/202 |
| 4,419,160 | 12/1983 | Wang et al. . | |
| 4,506,853 | 3/1985 | Cathey | 248/79 |
| 4,544,173 | 10/1985 | Kellermyer | 248/129 |
| 4,559,006 | 12/1985 | McGill et al. | 431/5 |
| 4,738,242 | 4/1988 | Hart | 431/344 |
| 4,779,608 | 10/1988 | Smith . | |
| 4,900,244 | 2/1990 | Keller et al. | 431/5 |
| 4,964,529 | 10/1990 | Houston | 206/443 |
| 5,364,262 | 11/1994 | Phillips | 431/5 |
| 5,380,195 | 1/1995 | Reid et al. | 431/202 |
| 5,765,788 | 6/1998 | DeCanio | 248/79 |

OTHER PUBLICATIONS

P. 14 (1 sheet) Canadian Regulations for Gas Fitting CAN/CGA–B149.2–M91.

Pp. 63 & 64 (1 sheet) Canadian Regulations for Gas Fitting CAN/CGA–B149.2–M91.

*Primary Examiner*—Ira S. Lazarus
*Assistant Examiner*—David Lee
*Attorney, Agent, or Firm*—Adrian D. Battison; Murray E. Thrift

[57] ABSTRACT

Purging of a gas supply line is effected using a serviceman's purging tool having a hose for attachment to the supply line with an opposite end of the hose attached to a burner nozzle carried on a support frame. The burner nozzle is arranged to generate a stream of the gases exiting from the pipe to be purged. The frame carries a receptacle for a propane torch and angles the burner of the torch so as to be directed across the stream of gas from the supply pipe. The burner from the torch thus provides combustion of the purged non-ignitable products from the supply pipe until the ignitable gas reaches the nozzle whereupon the ignitable gas is ignited indicating that the pipe is purged. The receptacle comprises a cylindrical sleeve for receiving the tank of the propane torch and a bracket for guiding the nozzle of the torch across the stream.

11 Claims, 2 Drawing Sheets

GAS BURNER TOOL FOR PURGING A GAS SUPPLY PIPE

BACKGROUND OF THE INVENTION

This invention relates to a gas burner tool for use in purging a gas supply pipe.

In gas fitting, installation of new equipment or appliance generally requires the appliance be attached to a gas supply pipe carrying gas from a remote source such a main supply or a propane supply tank. In some cases the gas supply pipe is relatively long and this is particularly a problem in supply of propane where the tank is necessarily located at some distance from the main building and the appliance.

After the installation is complete, it is necessary to commence supply of gas through the pipe from the source to the installed appliance and to ignite that gas when the combustible gas reaches the appliance.

Generally the combustible gas is preceded in the supply pipe with a non-combustible gas including air, various solvents from the piping, desiccants to remove water vapor from the pipe and the like. Often these non-combustible gases include noxious smelling agents of the type added to combustible gas to provide a characteristic smell.

Up until now, gas fitters have in many cases simply turned on the gas supply so that the non-combustible gas is purged through the pipe at the installed equipment or to the outside and have waited a sufficient period of time for the non-combustible gas to escape, after which the combustible gas is ignited.

This leads to two problems. Firstly the non-combustible gas is released into the atmosphere which can release noxious materials and foul smelling gases. Secondly, if the gas fitter waits too long, the combustible gases can be released into the building where the danger of explosion either immediately at ignition of the installed appliance or subsequently when the conditions have reached the optimum for explosion to occur. This is particularly a problem with propane which is heavier than air and therefore settles at floor level so that it is less detectable. The release of the non-combustible gases can also mask the characteristic odour added to the combustible gas.

It is known to flare off purged gases to the outdoors. For example, the Canadian regulations for gas fitting CAN/CGA-B149.2-M91 define on page 14 a "purge burner" as "a burner equipped with a constant ignition source and a flame arrestor intended to burn the escaping (discharged) propane during purging operations". The same document refers to purging to the outdoors on page 63 and in 5.24.7 states that "when flaring is used to purge a piping or tubing system an approved purge burner is to be used". However no apparatus for assisting a fitter in purging a pipe primarily in an indoors situation is known to exist.

A search has revealed U.S. Pat. Nos. 4,779,608, 4,276,017 and 4,419,160, but these do not provide devices suitable for this purpose.

SUMMARY OF THE INVENTION

It is one object of the present invention, therefore, to provide a tool for use in purging a gas pipe.

According to the first aspect of the invention there is provided a tool for use in gas fitting comprising a hose line having a coupling at one end for attachment to a gas pipe, a first burner nozzle attached to an opposed end of the hose line for generating a stream of gas from the gas pipe, a venturi for drawing air into the stream of gas, and means for burning the stream of gas comprising a second burner nozzle for directing a burning gas into the stream and means for attaching the second burner nozzle to a supply of gas separate from said gas pipe.

Preferably the second burner nozzle is arranged to direct the burning gas at an angle across the stream.

Preferably the tool includes a supply of gas comprising a portable tank containing propane, the propane supply and the second burner nozzle being arranged such that the burning gas from the second nozzle has sufficient heat to cause combustion of at least some non-combustible products emerging from the first burner nozzle during purging of the gas supply line and to cause ignition of combustible gas emerging from the first burner nozzle when purging of the gas supply line is complete.

Preferably the tool includes a supply of gas comprising a portable tank wherein the tool includes a portable frame having a first receptacle on the frame for receiving and supporting the portable tank and a second receptacle for locating the second burner nozzle.

Preferably the first receptacle comprises a cylindrical sleeve.

Preferably the second receptacle for the second burner nozzle comprises an upstanding support arm carried on the first receptacle for the tank and defining a notch into which the second burner nozzle located.

Preferably the first burner nozzle stands generally upwardly.

Preferably the tool includes a base frame for resting upon a support surface and carrying the first burner nozzle.

Preferably the tool includes a protective grid surrounding the first burner nozzle.

Preferably the first burner nozzle includes a flame arrestor.

Preferably the tool includes a hanger for receiving and supporting the hose line in stored condition.

Preferably the tool includes a base frame and a plurality of receptacles each for receiving a respective one of the plurality of gas fittings by which the coupling of the hose line can be attached to a number of different types of gas pipe outlets.

According to a second aspect of the invention there is provided a tool for use in gas fitting comprising a frame with a base for resting upon a support surface, a hose line having a coupling at one end for attachment to a gas pipe to be purged, a first burner nozzle mounted on the frame so as to stand generally upwardly therefrom, the first burner nozzle being connected to an opposed end of the hose line for generating a stream of gas from the gas pipe, a venturi mounted on the first burner nozzle for drawing air into the stream of gas, and a receptacle mounted on the base frame for receiving and supporting a gas torch having a second burner nozzle and a gas supply tank attached thereto, the receptacle being arranged to receive and mount the torch such that the second burner nozzle of the torch directs a stream of burning gas into the stream from the first burner nozzle.

According to a third aspect of the invention there is provided a method for purging a gas supply pipe comprising attaching a coupling on the gas supply pipe to one end of a hose line, providing a burner nozzle at an opposed end of the hose line for generating a stream of gas purging from the gas supply pipe, providing a stream of burning gas from a supply separate from the gas supply pipe, directing the stream of burning gas into the stream of gas from the gas supply pipe, the burning gas having sufficient heat to cause combustion of at least some non-combustible products in the gas supply line, and continuing to purge gas from the gas supply pipe until combustible gas emerges from the gas supply pipe and is ignited by the stream of burning gas.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
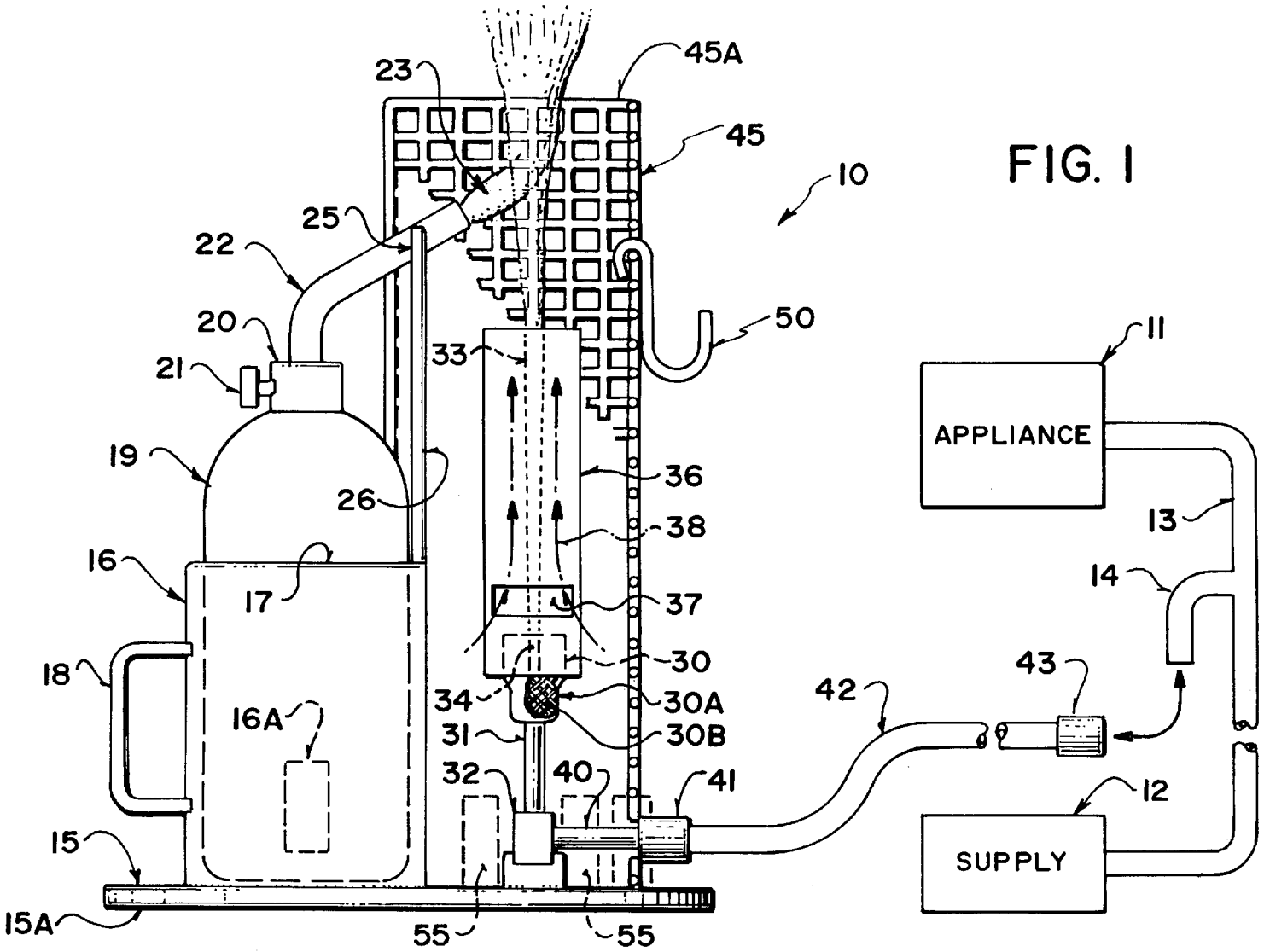
FIG. 1 is a side elevational view of a tool according to the present invention.
Figure 2:
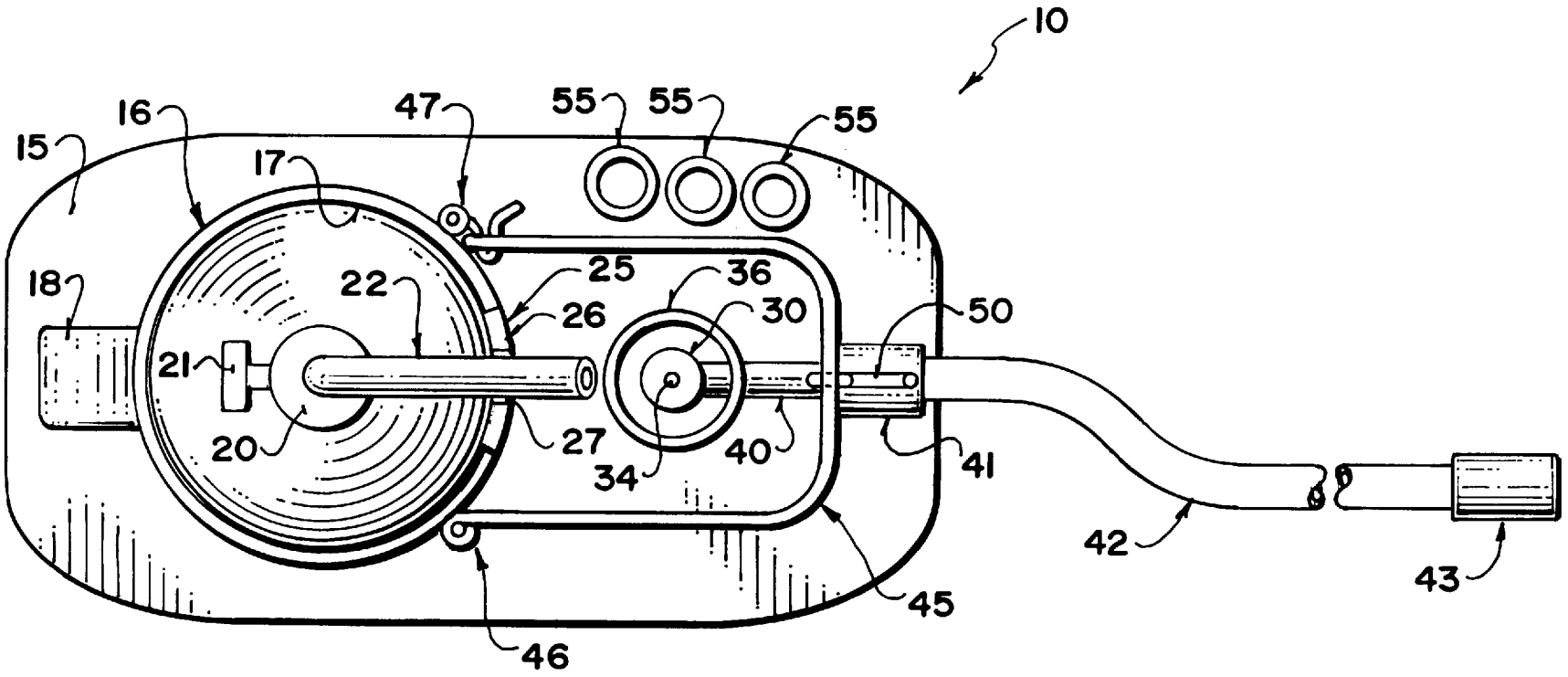
FIG. 2 is a top plan view of the tool of FIG. 1.

The tool is generally indicated at 10 for use in installation of an appliance at 11 to a gas supply 12 including an installed gas supply pipe 13 for carrying gas from the supply to the appliance.

The gas supply pipe 13 includes a drop leg 14 adjacent the appliance of a conventional nature necessary for extracting contaminants from the gas line.

The tool 10 comprises a flat base plate 15 which is generally rectangular in shape with curved corners for aesthetic appearance. The base plate 15 carries an upstanding cylindrical receptacle 16 which is attached at its bottom end to the plate and has an open mouth 17 at its upper end. A handle 18 is attached to one side of the receptacle 16 so that the tool can be manually grasped and carried from place to place. The handle is located in a position so that the base plate 15 can be carried in horizontal orientation with an underside 15A laid upon a support surface to hold the receptacle 16 vertical.

The receptacle 16 receives a conventional propane bottle 19 and is dimensioned to receive an contain the bottle and hold that bottle vertical within the receptacle. A spring clip 16A frictionally retains the bottle in the receptacle. At an upper end of the bottle is provided a control valve 20 which allows release of a gas from the bottle on actuation of a manually operable valve element 21. On top of the valve 20 is mounted a burner nozzle 22 which then includes a first portion extending vertically upwardly from the bottle and a second portion inclined upwardly and to one side of the bottle. Such gas burner torches are of course well known and readily available from all plumbing and similar stores for use in generating a stream of burning gas as indicated at 23 for various purposes.

The tool 10 further includes a second receptacle 25 in the form of an upstanding plate 26 attached to one side of the cylindrical receptacle 16 and standing upwardly therefrom. The plate 26 includes a notch 27 defined between a pair of upstanding fingers so the notch receives an undersurface of the nozzle 22 to locate that nozzle in between the fingers and directing the nozzle to a required angular orientation around the axis of the cylindrical receptacle 16.

The tool further includes a gas burner nozzle 30 attached to a vertical gas pipe 31 carried on an elbow 32. The elbow 32 is fixed to the base plate 15 so as to hold the pipe 31 vertical and to locate the nozzle 30 in a vertical orientation to form a vertical stream 33 of gas exiting from the nozzle 30. The nozzle 30 has a relatively small orifice 34 so that the gas exiting from the nozzle forms a vertical stream which is relatively narrow and remains as a consistent stream with little diffusion to a height of the stream above the burning gas stream 23. Behind the nozzle 30 between the nozzle and the pipe 31 is provided a flame arrestor 30A formed of a wire mesh material 30B or similar known arrangement to prevent any flame at the nozzle from traveling back through the pipe to the supply.

Around the nozzle 30 is mounted a sleeve 36 having an inlet opening 37 around the nozzle 30 so the sleeve and the nozzle act as a venturi drawing air into the opening 37 and mixing that air as indicated generally at 38 with the stream 33.

The elbow 32 is attached to a horizontal pipe section 40 which includes a coupling 41 at its outer end attached to a flexible hose 42. An opposed end of the flexible hose 42 carries a coupling 43 for attachment to the drop leg 14.

The particular details of the couplings are not shown as these are well known to one skilled in the art and can vary in dependence upon the particular gas fittings selected for the various elements.

Around the sleeve 36 is mounted a guard screen 45 formed of a suitable perforated screen material. The screen material extends from the base plate 15 up to a top edge 45A at a height above the nozzle 22 so as to confine the flame for preventing communication of significant heat to any surrounding combustible materials. The guard screen is U shaped in plan and extends from a hinge 46 at one side of the cylindrical receptacle 16 around the sleeve 36 and the nozzle 30 to a latch 47 on an opposed side of the cylindrical receptacle 16. The screen or grid 45 thus prevents the user from inadvertently contacting the sleeve during operation of the tool. A hanger 50 in the from of a J-shaped loop is attached to the screen 45 and provides a hook for receiving loops of the hose 42 looped thereover.

On the base plate 15 is mounted a plurality of receptacles 55 each for receiving a certain one a plurality of gas fittings suitable for attachment to the coupling 43 also the gas fittings are selected so that they provide an array of types of fittings which are suitable for accommodating various different types of couplings in the gas supply and appliance system. Thus the coupling 43 can be attached using one or other of the selected fittings to the drop leg or to a gauge port on the appliance itself. Similar gauge ports are also provided in other areas of the supply and appliance system so that the gas fitter can attach the fitting to a number of different locations through the system as required to purge gas at different locations in the system.

The tool can of course be supplied without the conventionally available propane torch and burner.

In operation the gas fitter when the appliance is installed attaches the coupling 43 to a suitable location at or adjacent the appliance. When the connection is complete, the gas from the torch is ignited thus generating the burning stream 23. The nozzle 22 is located so that it directs the burning stream across the top of the grid or screen 45 at an angle upwardly.

With the gas stream 23 ignited and generating a significant heat generally greater than 1200° F. and preferably of the order of 1500° F., the supply is opened using the conventionally available valves so that gases in the supply line 13 are purged through the hose 42 and into the burner nozzle 30.

It can be appreciated that initially the gases purged are non-combustible including air, various solvents, and other materials which are formed into the stream 33 and mixed with air to form a narrow stream exiting from the top of the sleeve 36 and from the top of the screen 45 and intersecting with the burning stream 23.

While the non-combustible products in the line 13 are ejected through the nozzle 30, these products do not directly ignite, particularly because the mixture with air is not at the right proportions for combustion, but are consumed in the heated jet 23 to burn off hydrocarbons and noxious gases to remove the foul odor and to prevent the release of such noxious material into the atmosphere.

As soon as the combustible gas fills the pipe line 13 and passes into the hose 42, the combustible gas reaches the nozzle 30 and mixes with the air thus becoming combustible in the stream 33 so that the heated stream 23 ignites the stream 33 and demonstrates by that ignition to the fitter the fact that the combustible gas has reached the coupling 43 and thus filled the line 13.

Once the ignition of the gas has occurred and had remained steady it is clear that all of the non-combustible gases have been extracted and all of the combustible gases which have been emitted from the supply line have been burnt thus preventing any remaining combustible gases from escaping into the area surrounding the appliance. Because of the presence of the venturi which adds air into the gas stream, any combustible gas which reaches the nozzle in admixture with air in the pipe will not ignite as the mixture will be too lean for ignition. The combustible gases will however burn off in the flame from the torch. Only when the combustible gas reaches the nozzle substantially in pure form will it ignite thus giving a visual indication of the arrival of the pure supply gas.

The supply is then closed off, the torch is turned off, the coupling 43 removed from its location and the location is capped to prevent further escape of gases. In this situation, therefore, it is known that the supply line 13 is filled with the combustible gas and that combustible gas is carried to the location immediately adjacent or at the appliance. The appliance can therefore be ignited substantially immediately since the gas is at the appliance and ready for ignition.

The tool therefore prevents of inhibits the possibility of escape of combustible gases, provides a visual indication of the arrival of the pure supply gas in combustible form and also burns off the non-combustible products carried in the supply line to prevent the escape of noxious materials.

If required, a known blow-back combustion arrestor (not shown) can be added into the lie upstream of the nozzle.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for use in gas fitting comprising:

a manually portable frame with a base for resting upon a support surface;

a hose line having a coupling at a first end for attachment to a gas pipe to be purged;

a first burner nozzle mounted on the frame so as to stand generally upwardly therefrom, the first burner nozzle being connected to a second opposed end of the hose line for generating a stream of gas from the gas pipe;

a venturi mounted on the first burner nozzle for drawing air into the stream of gas;

a portable gas torch having a burner torch portion and a gas supply tank attached thereto;

and a mounting assembly mounted on the base frame for receiving and supporting the gas torch, the mounting assembly including a receptacle carried on the base frame arranged to receive and mount the supply tank for ready insertion into and removal from the receptacle and a support bracket carried on the base frame and arranged to engage the burner torch portion such that the burner torch portion is carried on the base frame and is located thereon at a position to direct a flame of burning gas into the stream from the first burner nozzle.

2. The apparatus according to claim 1 wherein the support bracket is arranged such that the burner torch portion directs the flame of burning gas at an angle across the stream.

3. The apparatus according to claim 1 wherein the receptacle comprises a cylindrical sleeve for surrounding a cylindrical wall of the supply tank.

4. The apparatus according to claim 1 wherein the burner torch portion includes a tube rigidly attached to the supply tank and having a portion thereof inclined away from a longitudinal axis of the supply tank and wherein the support bracket includes an arm having a notch for locating the tube at a required angle angularly around the longitudinal axis.

5. A method for purging a gas supply pipe for supplying combustible gas from a supply to an appliance comprising:

providing an appliance to be supplied with combustible gas;

connecting the supply pipe from the supply to the appliance such that the supply pipe is not yet filled with the combustible gas;

providing a portable device for use in purging the supply pipe, the portable device including:

a supporting frame by which the device can be manually lifted and carried;

a hose line attached to the frame having a coupling at a first end for attachment to the supply pipe;

a first burner nozzle attached to a second opposed end of the hose line for generating a stream of gas from the supply pipe;

a venturi at the first burner nozzle for drawing air into the stream of gas;

a portable supply of combustible gas carried on said supporting frame;

and a second burner nozzle for directing said combustible gas from said portable supply into the stream of gas;

manually carrying the portable device to a position adjacent the appliance;

attaching the gas supply pipe to said coupling on said one end of the hose line;

causing the combustible gas to flow from the supply through the supply pipe to generate a stream of non-combustible gas purging from the supply pipe;

igniting said combustible gas from said portable supply so as to cause a stream of burning gas from said portable supply;

directing the stream of burning gas into the stream of gas purging from the supply pipe until combustible gas emerges from the supply pipe and is ignited by the stream of burning gas;

observing the ignition of the gas purging from the supply pipe to determine the ignition thereof;

and, when the ignition has occurred, shutting off the flow from the supply into the supply pipe, disconnecting the coupling on said one end of the hose from the supply pipe and removing the device from the appliance.

6. The method according to claim 5 wherein the second burner nozzle is provided as a burner torch arranged to direct the burning gas as a flame passing at an angle across the stream.

7. The method according to claim 6 wherein the burner torch is arranged to have sufficient heat to cause combustion of at least some non-combustible products emerging from the first burner nozzle during purging of the supply line.

8. The method according to claim 6 including providing on the portable frame a cylindrical sleeve for receiving and supporting the portable supply and a receptacle for locating and directing the burner torch.

9. The method according to claim 8 wherein the receptacle for the burner torch comprises an upstanding support arm carried on the cylindrical sleeve and defining a notch in which the burner torch sits.

10. The method according to claim 5 including providing a hook for receiving and supporting the hose line in stored condition.

11. The method according to claim 5 including providing on the portable frame plurality of receptacles each for receiving a respective one of the plurality of gas fittings by which the coupling of the hose line can be attached to a number of different types of supply pipe outlets.

* * * * *